US011511964B2

(12) United States Patent
Tatikola et al.

(10) Patent No.: US 11,511,964 B2
(45) Date of Patent: Nov. 29, 2022

(54) SYSTEM FOR MONITORING LOBBY ACTIVITY TO DETERMINE WHETHER TO CANCEL ELEVATOR SERVICE

(71) Applicant: Otis Elevator Company, Farmington, CT (US)

(72) Inventors: Pramod Parimala Tatikola, Telangana (IN); Sasikanth Singamsetty, Telangana (IN); Madhavaraju Nadimpalli, Telangana (IN); Vamsi Krishna Grandhi, Telangana (IN); Raghavendra Rao Veera Yerramsetty, Telangana (IN); Jayapal Reddy Gireddy, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 623 days.

(21) Appl. No.: 16/661,370

(22) Filed: Oct. 23, 2019

(65) Prior Publication Data

US 2020/0130994 A1 Apr. 30, 2020

(30) Foreign Application Priority Data

Oct. 24, 2018 (IN) ..... 201811040102

(51) Int. Cl.
*B66B 1/16* (2006.01)
*B66B 1/46* (2006.01)
(Continued)

(52) U.S. Cl.
CPC ..... *B66B 1/468* (2013.01); *B66B 1/2408* (2013.01); *B66B 1/3492* (2013.01)

(58) Field of Classification Search
CPC ..... B66B 1/468; B66B 1/2408; B66B 1/3492; B66B 1/3476; B66B 1/2458; B66B 1/18; B66B 1/3415; B66B 5/0012
(Continued)

(56) References Cited

U.S. PATENT DOCUMENTS 3,556,256 A 1/1971 Sprague
4,662,479 A 5/1987 Tsuji et al.
(Continued)

FOREIGN PATENT DOCUMENTS

CN 1198143 A 11/1998
CN 1152820 C * 6/2004 ..... B66B 1/468
(Continued)

OTHER PUBLICATIONS

European Search Report; Application No. 19205212.4; dated Jul. 15, 2020; 35 pages.
(Continued)

*Primary Examiner* — Mahendra R Patel
(74) *Attorney, Agent, or Firm* — Cantor Colburn LLP

(57) ABSTRACT

Disclosed is an elevator system in a building, the elevator system including a first elevator car for transporting a passenger between a plurality of building levels, the system including a controller that controls the elevator car, the controller: rendering a first determination that the passenger has requested elevator service from the first lobby, rendering a second determination to assign the elevator car to provide service to the passenger at a first lobby for the first level, effecting a first transmission to the elevator car to effect the second determination, rendering a third determination that the first lobby becomes unoccupied in a time period between effecting the first transmission and the elevator arriving at the first lobby for servicing the first passenger, rendering a fourth determination to release the elevator car from effect-
(Continued)

ing the second determination, and effecting a second transmission to the elevator car to effect the fourth determination.

14 Claims, 3 Drawing Sheets

(51) Int. Cl.
*B66B 1/24* (2006.01)
*B66B 1/34* (2006.01)

(58) Field of Classification Search
USPC ..... 187/380
See application file for complete search history.

(56) References Cited

U.S. PATENT DOCUMENTS

| | | | | | |
|---|---|---|---|---|---|
| 5,168,135 | A * | 12/1992 | Kubo | B66B 3/00 | 187/382 |
| 5,248,860 | A * | 9/1993 | Sirag, Jr. | B66B 1/2408 | 706/900 |
| 5,563,386 | A | 10/1996 | Powell et al. | | |
| 6,109,396 | A | 8/2000 | Sirag et al. | | |
| 6,209,685 | B1 | 4/2001 | Zaharia | | |
| 6,257,373 | B1 | 7/2001 | Hikita et al. | | |
| 7,711,565 | B1 * | 5/2010 | Gazdzinski | B66B 1/468 | 369/30.01 |
| 3,061,485 | A1 | 11/2011 | Finschi | | |
| 8,437,954 | B1 * | 5/2013 | Freeman | G01C 21/206 | 701/426 |
| 8,960,373 | B2 * | 2/2015 | De Vincentis | B66B 1/3476 | 187/381 |
| 9,856,107 | B2 | 1/2018 | Haipus et al. | | |
| 9,878,874 | B2 | 1/2018 | Kondo et al. | | |
| 2008/0236956 | A1 * | 10/2008 | Finschi | B66B 3/00 | 340/5.2 |
| 2009/0050417 | A1 * | 2/2009 | de Groot | B66B 1/2458 | 187/387 |
| 2009/0288919 | A1 * | 11/2009 | Flynn | B66B 1/468 | 187/247 |
| 2013/0233653 | A1 * | 9/2013 | Chen | B66B 1/3476 | 187/381 |
| 2015/0066782 | A1 * | 3/2015 | Vainberg | G06Q 10/20 | 705/305 |
| 2016/0122157 | A1 | 5/2016 | Keser | | |
| 2016/0297642 | A1 | 10/2016 | Finn | | |
| 2017/0327344 | A1 * | 11/2017 | Richmond | B66B 1/468 | |
| 2018/0086597 | A1 | 3/2018 | Song et al. | | |
| 2018/0127235 | A1 | 5/2018 | Scoville et al. | | |
| 2018/0237256 | A1 * | 8/2018 | Yamada | B66B 1/3476 | |
| 2019/0346588 | A1 * | 11/2019 | Hsu | B66B 3/00 | 340/5.2 |

FOREIGN PATENT DOCUMENTS

| | | | | | |
|---|---|---|---|---|---|
| CN | 101774501 | A * | 7/2010 | B66B 1/2458 | |
| CN | 104276462 | A | 1/2015 | | |
| CN | 105438902 | A | 3/2016 | | |
| CN | 105905766 | A | 8/2016 | | |
| CN | 207209627 | U | 4/2018 | | |
| CN | 108249236 | A * | 7/2018 | | |
| CN | 108249236 | A | 7/2018 | | |
| EP | 3590878 | A2 | 1/2020 | | |
| GB | 2199164 | A * | 6/1988 | B66B 1/2458 | |
| JP | S5076563 | U | 7/1975 | | |
| JP | S53128844 | A | 11/1978 | | |
| JP | 2013049561 | A | 3/2013 | | |
| JP | 2013049561 | A * | 3/2013 | | |
| KR | 20100026517 | A | 3/2010 | | |
| WO | WO-9719884 | A1 * | 6/1997 | B66B 1/2458 | |
| WO | WO-2009024853 | A1 * | 2/2009 | B66B 1/2458 | |
| WO | 2014163331 | A1 | 10/2014 | | |

OTHER PUBLICATIONS

European Search Report; Application No. 19205212.4; dated Apr. 14, 2020; 36 pages.
Chinese Office Action; dated Apr. 28, 2022; Application No. 201911012345.8; Filed: Oct. 23, 2019; 6 pages.
Chinese Application No. 201911012345.8 filed Oct. 23, 2019; Chinese Office Action dated Sep. 24, 2021; 9 pages.

* cited by examiner

SYSTEM FOR MONITORING LOBBY ACTIVITY TO DETERMINE WHETHER TO CANCEL ELEVATOR SERVICE

CROSS-REFERENCE TO RELATED APPLICATIONS

This application claims the benefit of Indian Application No. 201811040102, filed Oct. 24, 2018, the disclosure of which is incorporated herein by reference in its entirety.

BACKGROUND

The embodiments herein relate to an elevator system and more specifically to an elevator system configured to monitor lobby activity to determine whether to cancel elevator service.

Passengers may call for elevator service and fail to remain at a landing long enough to use called service. This may create an inconvenience for other passengers resulting in delays and excess travel time.

SUMMARY

Disclosed is an elevator system in a building with a plurality of lobbies and a respective plurality of levels, including a first level that includes a first lobby, the elevator system including a first elevator car for transporting a passenger between the plurality of levels, the system comprising a controller that controls the first elevator car, the controller being configured to render a plurality of determinations and effect a plurality of transmissions including: a first determination that the passenger has requested elevator service from the first lobby, a second determination to assign the elevator car to provide service to the passenger at the first lobby, a first transmission to the first elevator car to effect the second determination, a third determination that the first lobby becomes unoccupied in a time period between effecting the first transmission and the elevator arriving at the first lobby for servicing the first passenger, a fourth determination to release the first elevator car from effecting the second determination, and a second transmission to the first elevator car to effect the fourth determination.

In addition to one or more of the above disclosed features or as an alternate the system includes a sensor operationally connected to the controller, wherein when effecting the third determination the controller receives data from the sensor indicative of the sensor failing to detect the first passenger in the first lobby in the first period of time.

In addition to one or more of the above disclosed features or as an alternate the sensor transmits to the controller real time data to the controller during the first period time, whereby the controller effects the third determination.

In addition to one or more of the above disclosed features or as an alternate the system includes the sensor is one or more of a thermal sensor and a motion sensor.

In addition to one or more of the above disclosed features or as an alternate the system includes the first lobby includes a first entryway, wherein when rendering the third determination the controller processes the real time data from the sensor to determine whether the passenger exits the first lobby through the first entryway.

In addition to one or more of the above disclosed features or as an alternate the system includes a plurality of elevators including the first elevator car and a second elevator car, the plurality of elevators configured to transport the passenger from between the plurality of lobbies, including the first lobby, and wherein when rendering the third determination the controller processes the real time data to determine whether the passenger enters the second elevator car.

In addition to one or more of the above disclosed features or as an alternate the system includes an elevator control panel disposed in the first lobby and the controller renders the first determination upon receiving user input through the elevator control panel.

In addition to one or more of the above disclosed features or as an alternate the controller analyzes the senor data to determine whether engagement of the elevator control panel is indicative of an alert condition.

In addition to one or more of the above disclosed features or as an alternate the system includes a building management system (BMS) and the controller transmits an occurrence of an alert condition to the BMS.

In addition to one or more of the above disclosed features or as an alternate the controller communicates with the BMS over a wireless network.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
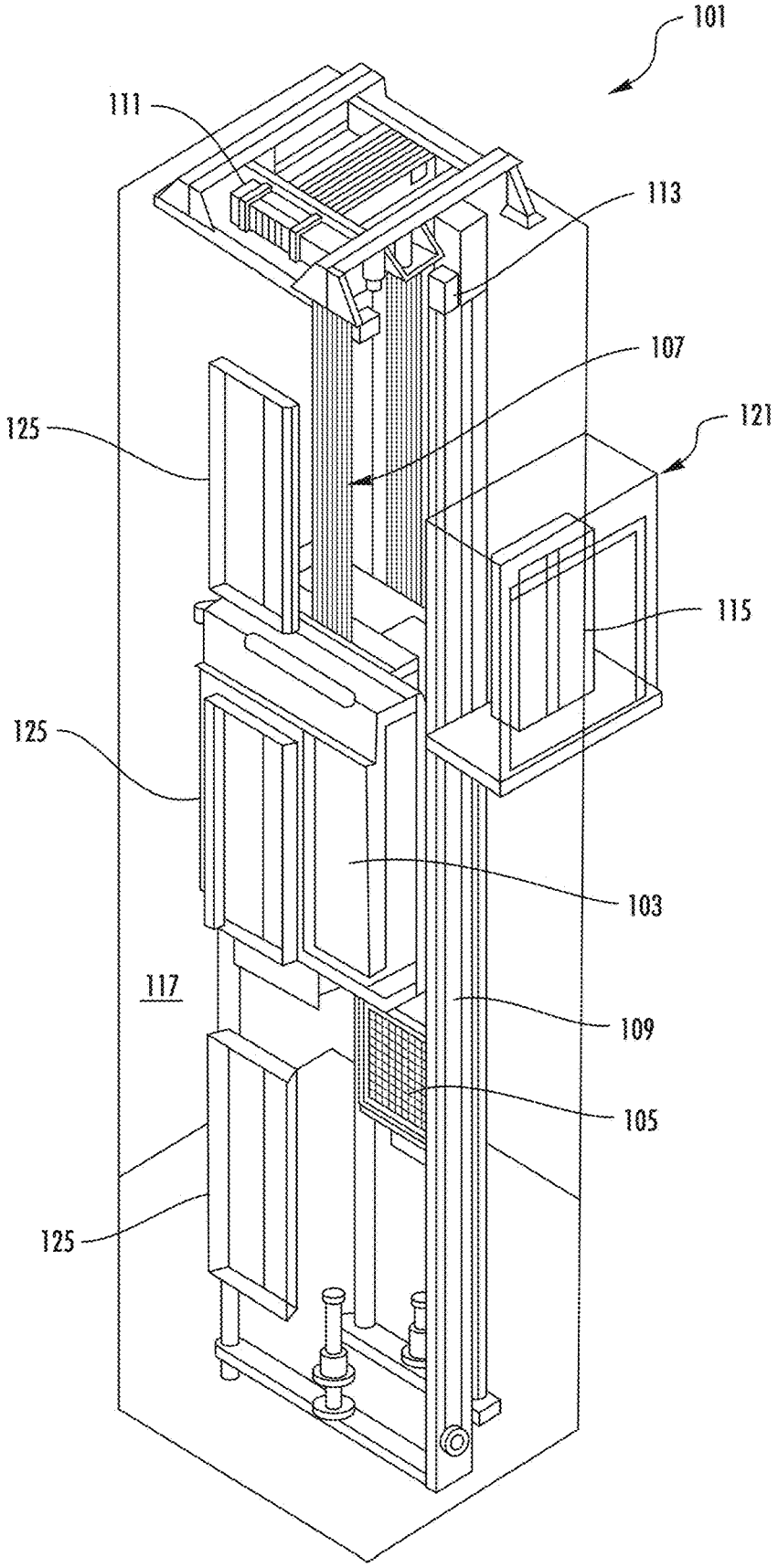
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator hoistway 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator hoistway 117, such as on a support or guide rail, and may be configured to provide position signals related to a position of the elevator car 103 within the elevator hoistway 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator hoistway 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator hoistway 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator hoistway 117.

Although shown and described with a roping system including tension member 107, elevator systems that employ other methods and mechanisms of moving an elevator car within an elevator hoistway may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
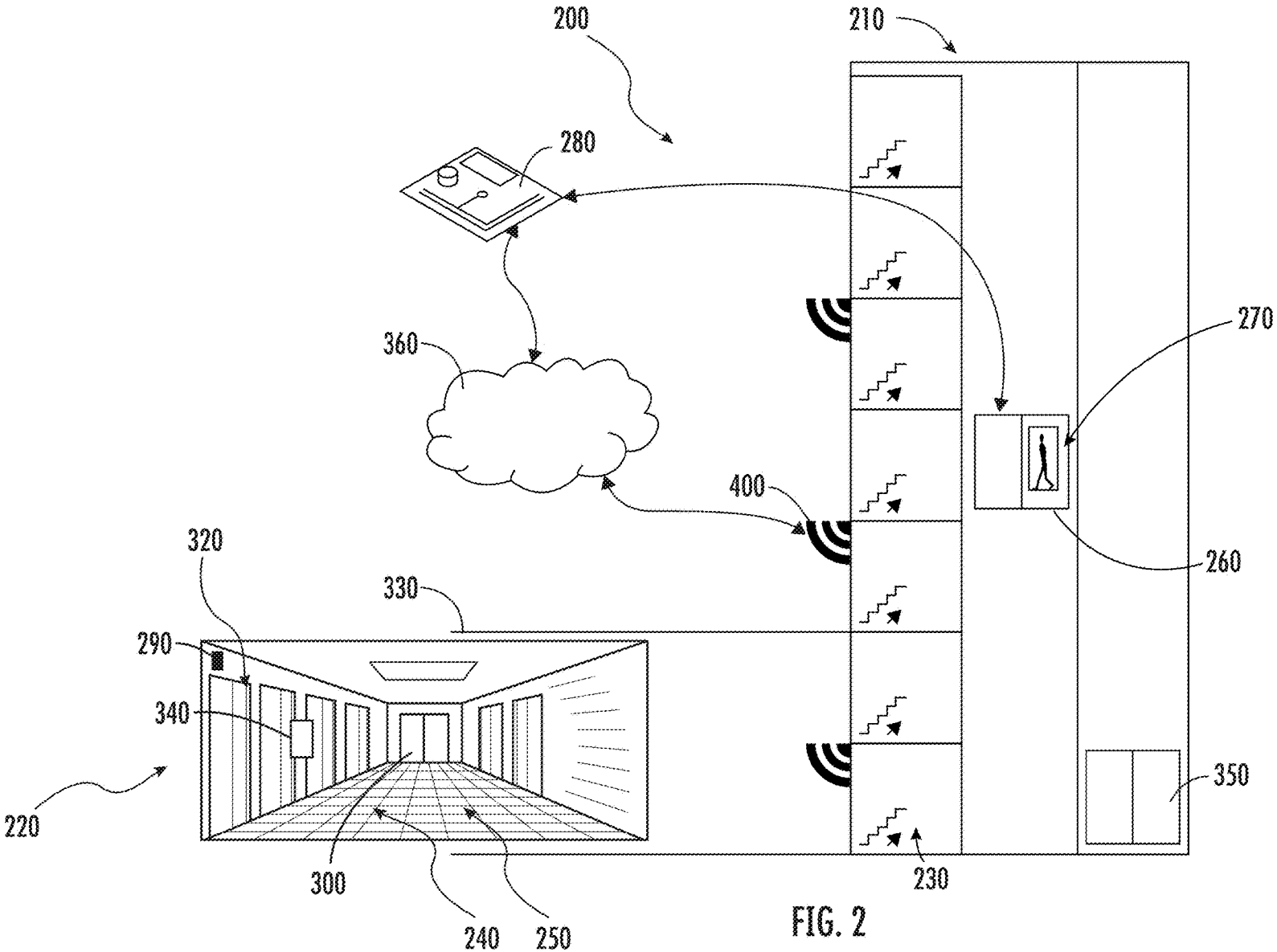
FIG. 2 illustrates components of a disclosed embodiment.

Turning to FIG. 2, disclosed is an elevator system 200 in a building 210 with a plurality of lobbies 220 and a respective plurality of levels 230, including a first level 240 that includes a first lobby 250. The elevator system 200 may include a first elevator car 260 for transporting a passenger 270 between the plurality of levels 230. The system 200 may include a controller 280 that controls the first elevator car 260.

Figure 3:
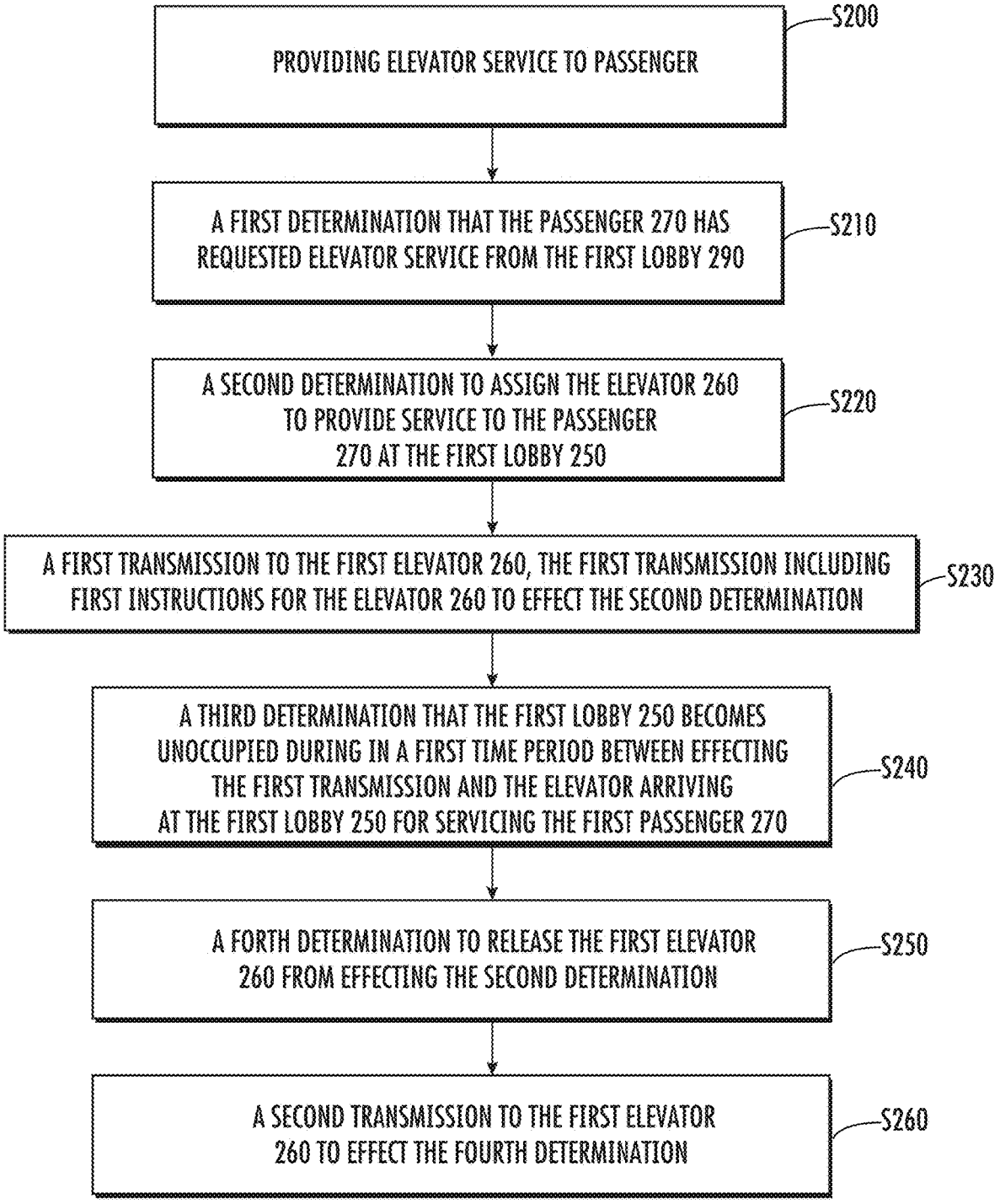
FIG. 3 illustrates steps performed by components according to an embodiment.

Turning to FIG. 3, the controller 280 may control the first elevator car 260 in a first process S200 of providing elevator service to the passenger. Step S200 may include the controller 280 rendering a plurality of determinations and effecting a plurality of transmissions. At step S210 the controller 280 renders a first determination that the passenger 270 has requested elevator service from the first lobby 250. At step S220 the controller 280 renders a second determination to assign the elevator car 260 to provide service to the passenger 270 at the first lobby 250.

At step S230 the controller 280 may effect a first transmission to the first elevator car 260, the first transmission including first instructions for the elevator car 260 to effect the second determination. At step S240 the controller 280 may render a third determination that the first lobby 250 becomes unoccupied during in a first time period between effecting the first transmission and the elevator arriving at the first lobby 250 for servicing the first passenger 270. At step S250 the controller 280 may render a forth determination to release the first elevator car 260 from effecting the second determination. At step S250 the controller 280 effects a second transmission to the first elevator car 260 to effect the fourth determination.

According to an embodiment the system includes a sensor 290 operationally connected to the controller 280. When effecting the third determination the controller 280 receives sensor data indicative of the sensor 290 failing to detect the first passenger 270 in the first lobby 250 in the first period of time. According to an embodiment the sensor 290 may transmit to the controller 280 real time data of the first lobby 250 during the first period of time, whereby the controller 280 effects the third determination. According to an embodiment the sensor 290 is one or more of a thermal sensor and a motion sensor.

The first lobby 250 may include a first entryway 300. Wherein when rendering the third determination the controller 280 may process the real time data from the sensor 290 to determine whether the passenger 270 leaves the first lobby 250 through the first entryway 300.

According to an embodiment the system may include a plurality of elevators including the first elevator car 260 and a second elevator car 350. The plurality of elevators may be configured to transport the passenger 270 from the first level 240 and a second level 330. When rendering the third determination the controller 280 processes the real time data from the sensor 290 to determine whether the passenger 270 enters the second elevator car 350.

According to an embodiment an elevator control panel 340 is disposed in the first lobby 250 and the controller 280 renders the first determination upon receiving user input through the elevator control panel 340. According to an embodiment the controller 280 analyzes the senor data to determine whether engagement of the elevator control panel 340 is indicative of an alert condition. The data may statically indicate that nuisance usage of the controller 280 is occurring. For example, if a first passenger 270 in relatively rapid succession engages in cycles of engaging the control panel 340 and leaves the first lobby 250, such activity may be statistically indicative of a nuisance usage of the system, potentially wasting system resources. According to an embodiment the system includes a building management system (BMS) 350 and the controller 280 transmits an occurrence of an alert condition to the BMS 350. The BMS may take further action to mitigate an occurrence of alert conditions. In one embodiment the controller 280 communicates with the BMS 350 over a wireless network 360, such as a wireless local area network (LAN) applying Wi-Fi protocols or through a beacon 400 with a personal area network (PAN) applying Bluetooth protocols.

According to the above embodiments a controller 280 uses at least image sensing to cancel an elevator call for a first elevator when (a) a passenger leaves a lobby on a second elevator car and no other passengers are waiting in the lobby, (b) the passenger presses decides not to use any elevator service, (c) the passenger calls elevators in both up and down directions and takes a first available elevator even though two elevators may be called to the lobby to provide service in both directions, (d) the passenger presses multiple calls with no intention to use elevator service, for example to cause a nuisance. The system provides for installing cameras in the elevator lobby which may capture real time images of the elevator lobby and process that information to determine whether a passenger is in the lobby. When no passenger is in the lobby, active call(s) to the lobby may be cancelled. A benefit of this service is reducing wasted time and energy for providing elevator service.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system in a building with a plurality of lobbies and a respective plurality of levels, including a first level that includes a first lobby, elevator system including a first elevator car for transporting a passenger between the plurality of levels, the system comprising a controller that controls the first elevator car, the controller being configured to render a plurality of determinations and effect a plurality of transmissions including:

a first determination that the passenger has requested elevator service from the first lobby, a second determination to assign the elevator car to provide service to the passenger at the first lobby, a first transmission to the first elevator car to effect the second determination, and a third determination that the first lobby becomes unoccupied in a time period between effecting the first transmission and the elevator arriving at the first lobby for servicing the first passenger, a fourth determination to release the first elevator car from effecting the second determination, and a second transmission to the first elevator car to effect the third determination; and wherein the first lobby includes a first entryway, wherein when rendering the third determination the controller processes the real time data from the sensor to determine whether the passenger exits the first lobby through the first entryway;

the system comprises a plurality of elevators including the first elevator car and a second elevator car, the plurality of elevators configured to transport the passenger from between the plurality of lobbies, including the first lobby, and wherein when rendering the third determination the controller processes the real time data to determine whether the passenger enters the second elevator car; and the system comprises an elevator control panel disposed in the first lobby and the controller renders the first determination upon receiving user input through the elevator control panel.

2. The system of claim 1 comprising a sensor operationally connected to the controller, wherein when effecting the third determination the controller receives data from the sensor indicative of the sensor failing to detect the first passenger in the first lobby in the first period of time.

3. The system of claim 2 wherein the sensor transmits to the controller real time data to the controller during the first period time, whereby the controller effects the third determination.

4. The system of claim 3 wherein the sensor is one or more of a thermal sensor and a motion sensor.

5. The system of claim 1 wherein the controller analyzes the senor data to determine whether engagement of the elevator control panel is indicative of an alert condition.

6. The system of claim 5 comprising a building management system (BMS) and the controller transmits an occurrence of an alert condition to the BMS.

7. The system of claim 6 wherein the controller communicates with the BMS over a wireless network.

8. A method of operating an elevator system in a building with a plurality of lobbies and a respective plurality of levels, including a first level that includes a first lobby, elevator system including a first elevator car for transporting a passenger between the plurality of levels, the system including a controller that controls the first elevator car, the method including the controller rendering a plurality of determinations and effecting a plurality of transmissions including:

a first determination that the passenger has requested elevator service from the first lobby, a second determination to assign the elevator car to provide service to the passenger at the first lobby, a first transmission to the first elevator car to effect the second determination, and a third determination that the first lobby becomes unoccupied in a time period between effecting the first transmission and the elevator arriving at the first lobby for servicing the first passenger, a fourth determination to release the first elevator car from effecting the second determination, and a second transmission to the first elevator car to effect the third determination; and wherein the first lobby includes a first entryway, wherein when rendering the third determination the controller processes the real time data from the sensor to determine whether the passenger exits the first lobby through the first entryway;

the system comprises a plurality of elevators including the first elevator car and a second elevator car, the plurality of elevators configured to transport the passenger from between the plurality of lobbies, including the first lobby, and wherein when rendering the third determination the controller processes the real time data to determine whether the passenger enters the second elevator car; and the system comprises an elevator control panel disposed in the first lobby and the controller renders the first determination upon receiving user input through the elevator control panel.

9. The method of claim 8 comprising a sensor operationally connected to the controller, wherein when effecting the third determination the controller receives data from the sensor indicative of the sensor failing to detect the first passenger in the first lobby in the first period of time.

10. The method of claim 9 wherein the sensor transmits to the controller real time data to the controller during the first period time, whereby the controller effects the third determination.

11. The method of claim 10 wherein the sensor is one or more of a thermal sensor and a motion sensor.

12. The method of claim 8 wherein the controller analyzes the senor data to determine whether engagement of the elevator control panel is indicative of an alert condition.

13. The method of claim 12 comprising a building management system (BMS) and the controller transmits an occurrence of an alert condition to the BMS.

14. The method of claim 13 wherein the controller communicates with the BMS over a wireless network.

* * * * *